US005660919A

United States Patent [19]

Vallee et al.

[11] Patent Number: 5,660,919

[45] Date of Patent: Aug. 26, 1997

[54] SHEET FOR SECURITY DOCUMENTS HAVING HIGH PRINTABILITY AND HIGH HANDLING RESISTANCE

[75] Inventors: Antoine Vallee, Charavines; Christophe Halope, Voiron, both of France

[73] Assignee: Arjo Wiggins S.A., Paris, France

[21] Appl. No.: 250,106

[22] Filed: May 26, 1994

Related U.S. Application Data

[63] Continuation of Ser. No. 917,145, filed as PCT/FR91/00097, Feb. 8, 1991 published as WO91/12372, Aug. 8, 1991, abandoned.

[30] Foreign Application Priority Data

Feb. 9, 1990 [FR] France ..... 90 01499
Oct. 26, 1990 [FR] France ..... 90 13310

[51] Int. Cl.[6] ..... D21H 21/40; D21H 19/36

[52] U.S. Cl. ..... 428/206; 101/150; 101/170; 162/112; 162/134; 162/135; 162/136; 162/137; 162/140; 283/57; 283/58; 283/59; 428/207; 428/208; 428/211; 428/323; 428/325; 428/331; 428/425.1

[58] Field of Search ..... 428/206, 207, 428/208, 211, 425.1, 514, 521, 522, 509, 510, 512, 513, 537.5, 323, 325, 331; 524/447, 571, 590; 101/150, 170; 283/57, 58, 59; 427/411; 162/112, 134, 135, 136, 137, 140

[56] References Cited

U.S. PATENT DOCUMENTS

| | | | |
|---|---|---|---|
| 3,281,267 | 10/1966 | Rice | 428/328 |
| 4,460,637 | 7/1984 | Miyamoto et al. | 428/212 |
| 4,740,420 | 4/1988 | Akutsu et al. | 428/341 |

FOREIGN PATENT DOCUMENTS 2300843 9/1976 France .

OTHER PUBLICATIONS

Casey, "*Pulp and Paper—Chemistry and Chemical Technology*" 1983, 2495–2496.

*Primary Examiner*—D. S. Nakarani
*Attorney, Agent, or Firm*—Bacon & Thomas

[57] ABSTRACT

A printable sheet having a high printing quality and a high handling resistance. At least one of the sides of the sheet is treated with a composition which comprises at least one filler and at least one elastomeric binder. The elastomeric binder is selected from the group consisting of aqueous dispersions of polyurethane, acrylate copolymers, optionally carboxylated styrene-butadiene copolymers, and polymers of which one of the monomers is acrylonitrile, isoprene, or neoprene, or mixtures thereof. The sheet can be used for manufacturing protected documents.

20 Claims, 1 Drawing Sheet

SHEET FOR SECURITY DOCUMENTS HAVING HIGH PRINTABILITY AND HIGH HANDLING RESISTANCE

This application is a continuation of application Ser. No. 07/917,145, filed as PCT/FR91/00097, Feb. 8, 1991, published as WO91/12372, Aug. 8, 1991, now abandoned.

BACKGROUND OF THE INVENTION

1. Field of the Invention

The invention concerns a sheet or film for use in the manufacture of securities documents, which is imprintable with high quality print, as well as being very resistant to the effects of circulation.

More particularly, the invention concerns paper sheets for banknotes or other valuable securities that can be imprinted by offset printing and/or by intaglio printing. Moreover, it relates to a composition for surface treatment of or for impregnating the face of a sheet in such manner as to simultaneously confer to it the properties of good imprintability and resistance to the effects of circulation.

2. Description of the Related Art

It is known that securities documents such as the paper for banknotes or checks or any other valuable securities comprise physical or chemical identification means and/or forgery indicators.

As a rule, it is known to use as chemical means compositions which react to the forgery agents presently used by forgers. These forgery indicator means react, for example, with acids (hydrochloric, citric, acetic, sulfuric etc.), with bases (especially soda), with oxidizers (javelle water), with reducing agents and with solvents.

It is also known to utilize physical identifiers which most often are the following:

- The lack of brighteners fluorescing in blue-violet when exposed to ultra-violet light which presently are used in ordinary papers to increase their whiteness.
- The exact presence of elements (for example, threads, fibers, disks etc.) which are fluorescent and emit variously colored fluorescences, are colored or comprise inscription, or which possess diverse physical properties such as magnetism, electrical conductivity, thermomagnetism etc.
- The presence of a watermark, that is, a controlled change in the density of the paper fibers throughout its thickness, this watermark showing a specific design which is only perfectly visible in transmitted light, i.e. by transparency.
- The presence of holograms, of moire patterns or other optical effects achieved using optically variable inks deposited at the sheet surface.
- The paper snap, that is a characteristic noise when the paper is quickly shaken.
- The presence of prints at the paper surface such as color inscriptions or drawings in complex forms that are difficult to reproduce.
- The printing relief obtained by intaglio printing. This process consists in engraving a plate, in spreading an ink on this plate and in pressing the sheet of paper on the plate.

As a rule, a securities document will not evince all such means because the cost of manufacturing the document increases with the number of identifiers and with their sophistication. However, the securities documents always comprise surface printing and therefore high-quality printing is required, both regarding the colors and the drawing, so as to make imitation difficult to counterfeiters. As a rule the public at large pays relatively little attention to the quality of the drawings and/or printing of the surface of a securities document, but trained bank personnel or merchants are quite sensitive to details of a drawing, its fineness and in general to its appearance, and accordingly are able to assess the authenticity of a document with the naked eye or with a magnifying glass.

The printing quality is taken from the fact that the line made by printing is perfectly clean, i.e., it lacks any smudges, and in the language of the man skilled in the art, it is free from "feathering". The result of such smudges is that the lines spread more than desired or that it is difficult to print lines that are very close without blurring. Consequently the central bank which imprints paper to obtain securities documents is forced to print in less than fine manner. It is therefore difficult to obtain microprints. Microprinting is highly useful for security items because it is difficult to reproduce by photocopier which presently are unable to reproduce very fine detail. The printing quality also is characterized by the color density of the print.

Furthermore, the resolution of the human eye is adequate to distinguish between good print quality and print containing "feathering."

According to the prior art, the printing quality of the securities documents has been fairly mediocre and it is thus easy to counterfeit them using those color photocopiers that are able to reproduce almost exactly the color tones of an authentic document. Such counterfeiting would not be obvious to the eye, even of a trained person, since the printing quality of the authentic document is not sufficiently superior to that of the image from the photocopier.

Consequently, sheets for use in the manufacture of securities documents require high printing quality in order to obtain prints which are difficult to counterfeit.

Moreover, the quality and the beauty of the printing contribute in equal measure to the image of the document issuer. For example, in the case of banknotes, the printing quality contributes to the prestige of the country circulating them. This is another reason for care in printing such documents.

Regarding printing and writing papers, it is known to improve their printing quality by depositing a coat of a binder-pigment mixture on their surface. The purpose of this treatment is to level out the paper surface, which inherently is quite irregular. The pigment particles fill the interstices between fibers constituting the sheet.

There is a very wide choice of pigments and binders to make such a coat. As a rule the pigments are mineral fillers, but sometimes they are plastic pigments. The binders may be selected from starch, casein, animal paste, polyvinyl alcohol, natural and synthetic latex, etc.

For example, pigmented coats containing bentonites have been researched in the area of conventional printing-writing papers (TAPPI vol. 59, #12, December 76, New York, pp 76–80; R. L. Janes et al).

The French patent 999,579 filed by NCR and published in 1952 discloses a printing paper resistant to ink spreading which is prepared by coating with a composition of clay crystals and a binder. This binder may be starch, polyvinyl alcohol, animal paste, or casein.

Likewise, the French patent 999,625 also filed by NCR discloses a similar paper with the coating containing a zeolite substance instead of the clay. The binder may be starch alone or in combination with casein and/or latex.

French patent application A 2,288,186 discloses a printing-writing paper coated with a composition comprising a coating pigment, a binder and an amorphous mineral product obtained synthetically, which product improves the imprintability of the paper.

However, in the very special case of sheets or films used for securities documents, it is exceedingly rare that their surface is a pigmented coating. The printing applied to sheet-based securities documents must withstand all mechanical actions that might degrade it. Considering their exchange value, these securities documents circulate among individuals and move into various machinery, for instance forged-document sensors, automatic vending machines, etc. In the course of such frequent handling and circulation, the documents are subjected to treatment that may degrade them, for instance they are folded, crumpled, wetted, scratched, they undergo various frictions and even may be washed if accidentally put into a washing machine. In the case of gravure, when such a document is being printed, very high pressure (frequently in excess of 50 MPa) is applied to the engraved and inked printing plates, whereby the ink very deeply enters the sheet and the printing is thus protected. The paper must be well compressible. One of ordinary skill in the art knows that a coat on the sheet will form a sure barrier to the ink and will lower the penetration and adhesion of the ink and hence its life in circulation.

Obviously a long print life is desired regardless of the kind of printing employed, whether intaglio printing, offset printing or other. Naturally, a man in the art knows that putting a pigmented coat on the surface of a sheet for printing securities documents in order to improve its printability will degrade the strength and life of the print. By its inherent composition, this coat would not be very resistant to the circulation stresses to which the securities documents are subjected.

Furthermore, when in circulation, the securities documents undergo soiling. Resistance to the effects of circulation also implies resistance to soiling. Therefore the sheet must also possess surface properties repellant to water, grease and evincing low porosity.

As a rule, to improve resistance to the effects of circulation, especially of banknotes, a sheet of paper is impregnated prior to printing in a bath containing essentially one or more binders selected for their very high mechanical properties.

French patent application A 2,300,843 filed by Polysar Co. describes a coated sheet of paper prepared by a procedure in which a composition containing a flexible latex polymer and non-gelatinized starch granules of an average diameter less than the mean interstice distance between the surface fibers of the paper is spread on the surface of this paper, any excess of the coating composition being removed and the coated paper being left to dry. This sheet of paper can be used for banknotes or for other securities. The sheet is coated with such a composition to improve its surface condition and hence its printability. The filler is organic since it is starch, and its particle diameter is large. While this application does mention the problem of print-life when these documents are in circulation, it fails to suggest a solution and also is silent on a criterion for such a print life.

SUMMARY OF THE INVENTION

Accordingly it is the object of the present invention to improve the printing quality of a sheet used for securities documents without degrading the resistance to the effects of circulation of the printed documents.

Another object of the invention is to improve the resistance to the effects of circulation of such documents.

Thus, the object of the invention is a sheet for making securities documents that simultaneously evinces the following properties:

high printing quality, and thus
- a smooth surface,
- good surface micro-porosity,
- oleophilic surface,
- good compressibility, high resistance to the effects of circulation, hence
- oleophobic and hydrophobic surface properties,
- low surface porosity,
- high affinity of printing ink for the sheet,
- high mechanical strength of the print.

It is clear that these required features may be conflicting.

Applicant has overcome the prejudices of the man in the art, and does subject the sheet surface to a treatment with a particular composition, which treatment may be, for example, a coating treatment.

After having tested many compositions containing at least one binder and at least one filler, applicant surprisingly succeeded in solving the above problems by resorting to a composition containing at least one filler and at least one elastomeric binder.

It is particularly surprising that, a composition containing a binder and a filler does not increase the susceptibility of the sheet to soiling while at the same time it does improve receptiveness of the sheet to inks.

Accordingly the invention provides an imprintable sheet for making securities documents, having a high printing quality and high resistance to the effects of circulation, said sheet being characterized in that at least one of its sides is treated with a composition comprising at least one filler and at least one elastomeric binder. More particularly, the elastomeric binder may be present in more than 25 parts per 100 parts of the fillers, by dry weight.

The elastomeric binder may be used in mixture with other conventional binders of papermaking. Tests by applicant have shown that binders such as starch or PVA, even when made insoluble, fail to provide the printing life required of securities documents when these binders are used by themselves with a filler.

The elastomeric binder may be selected from the group of aqueous dispersions of polyurethane, acrylate copolymers, optionally carboxylated styrenebutadiene copolymer, polymers in which one of the monomers is acrylonitrile or isoprene or neoprene, or their mixtures. Preferably polyurethane is used.

The composition may comprise other dispersant additives, viscosity modifiers, plasticizers, bacteriostatic agents or fungicides for example. It may also comprise other identifiers or anti-forgery agents.

The filler is preferably mineral, and it is preferably selected from the kaolins or silicas. However, it may optionally be selected from other coating pigments, for instance plastic pigments.

The filler may have any BET specific surface. It may also have a low specific surface as measured by the BET method (DIN 66,131), of about 5 to 20 $m^2/g$, or a high specific surface, for instance about 200 to 300 $m^2/g$ (the BET method measures the total specific surface).

Obviously, a mixture of fillers with different specific surfaces also may be used. It is particularly advantageous to use a portion of fillers having a fairly high BET specific surface.

Coaters of the reverse-roll, champion, bill-blade, trailing blade and airbrush types may be used to deposit the pigmented coat. Preferably, the airbrush coater is chosen. This kind of coating will not affect the watermark, that is, its relief.

The sheet to be treated in accordance with the invention may be a sheet having a base of a cellulosic composition which may be partially or totally synthetic, or a film of synthetic material. Preferably the sheet is of banknote paper.

Another object of the invention is to provide a composition to treat at least one side of a sheet and to impart to this sheet high printing quality and resistance to the effects of circulation, said composition being characterized by comprising at least one filler and one elastomeric binder.

DESCRIPTION OF THE PREFERRED EMBODIMENT

Figure 1:
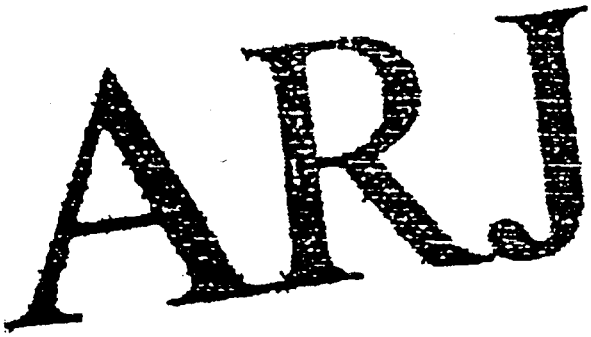
FIG. 1 is a photograph enlarged seven-fold of a printing of the first three letters of ARJOMARI made on a conventional banknote paper.

Preferably the composition for treating the sheet according to the invention comprises:

1 to 50 parts by dry weight of a filler, in particular a mineral filler, 2 to 40 parts by dry weight of an elastomeric binder, optionally a plasticizer, optionally other papermaking additives, the composition being produced in an aqueous medium and amounting to a total of 100 parts by weight.

The invention is implemented by means of the following preferred mode:

A sheet is made on a papermaking machine (flat table or round form), which optionally comprises a watermarking device, from a cellulose-fiber composition, for instance cotton fibers. Next this sheet is coated in an airbrush coater with an aqueous composition as follows:

1 to 50 parts by dry weight of a mineral filler, 2 to 40 parts by dry weight of a polyurethane binder, 0 to 5 parts by weight of glycerin, optionally other papermaking additives, the composition being in an aqueous medium and amounting to a total of 100 parts by weight.

The weight of the deposited coat is between 1 and 15 g/m$^2$ when dry, preferably about 10 g/m$^2$ when dry.

The sheets made according to the invention can be printed by intaglio printing or by offset, and their resistance to the effects of circulation is tested by the following four criteria:

resistance to crumpling when dry, resistance to crumpling when wet, resistance to rubbing (acidic, basic, oxidizing etc.)

resistance to soiling.

The results are examined visually with the naked eye or with a magnifier or microscope) and by comparison.

A control sheet that was not treated is compared with a sheet treated by the pigmented compositions according to the invention. It is found that the printing quality is clearly superior for the sheets of the invention and that the resistance to the effects of circulation of the sheet, especially following printing, is no less than that of the control. In some cases even it was improved.

The non-restrictive Examples below elucidate the manner in which the invention may be carried out practically.

The tests for resistance to the effects of circulation (crumpling and rub) are described in "Wearing quality of experimental currency-type papers", Journal of Research of the National Bureau of Standards, vol. 36, pp 249–268, March 1946.

The tests for resistance to soiling of the printed banknote papers are carried out as follows:

A. Dry Soiling

Each bill is crumpled in an IGT crumpling device. Then it is manually un-crumpled. It is next placed in a hermetically sealed flask in the presence of marbles of 20 mm diameter and 10-centime coins which were previously soiled with a powder containing yellow, brown, carbon black colorants and vermiculite. The flask is placed in a TURBULA apparatus which is rotated for 15 minutes.

B. Wet Soiling

The bill is subjected to preliminary crumpling. Then it is placed in a flask as above, but the powder containing the colorants and an artificial sweat composition are added.

The bills are compared to each other and with a control bill tested in the same conditions. The degree of soiling is gauged visually, or the whiteness is measured.

Comparative Example

A sheet is made on a papermaking machine from an aqueous suspension of cellulose fibers, optionally in mixture with mineral or synthetic fibers and other additives used in papermaking.

This sheet is coated using a #0.4 Meyer bar with an aqueous composition comprising, in the dry state, the following proportions of the total composition:

| | |
|---|---|
| a non-elastomeric binder | 5.7 parts |

polyvinyl alcohol, PVA KL 318, sold by Seppic

| | |
|---|---|
| a mineral filler | 11.5 parts |

bentonite Copisil D4A10, sold by SOCIETE FRANCAISE DES BENTONITES ET DERIVES,

| | |
|---|---|
| specific surface, (BET, nitrogen) | 270 m$^2$/g |

particle size: 2.5 micrometers

| | |
|---|---|
| a plasticizer | 4.5 parts |

glycerin

To control the viscosity, a rheological modifier is added, for instance carboxymethyl cellulose or a dispersion of acrylate/(meth)acrylic-acid. The final viscosity is 50 mPa.s at ambient temperature as measured with a Brookfield mobile viscosimeter #1 at 100 rpm. The coat weighs 11 g/m$^2$ in the dry state.

This sheet is printed by intaglio printing and it is then subjected to the tests for resistance to the effects of circulation cited above.

This sheet is compared with a control sheet made under the same conditions but not coated.

Compared with the control, the printing quality was improved but resistance to the effects of circulation suffered.

EXAMPLE 1

A sheet is manufactured on a papermaking machine from an aqueous suspension of cellulose fibers, optionally mixed with synthetic or mineral fibers and other conventional papermaking additives.

This sheet is coated using a #0.4 Meyer bar using an aqueous composition comprising, in dry proportion to the total:

| | |
|---|---|
| an elastomeric binder | 5.7 parts |

aqueous dispersion of polyurethane POLYURETHANE V sold by Bayer,

| | |
|---|---|
| a mineral filler | 11.5 parts |

calcined kaolin ALPHATEX sold by ECC International, with a specific surface (BET, nitrogen) of 11 $m^2$,

| | |
|---|---|
| a plasticizer | 4.5 parts |

glycerin.

A rheology modifier is added to control the viscosity. The final viscosity is 50 mPa.s at ambient temperature, measured with a mobile #1 Brookfield viscosimeter at 100 rpm. The dry weight of the coat is 11 $g/m^2$.

This sheet is printed by intaglio printing and then subjected to the above tests for resistance to the effects of circulation.

This sheet then is compared with the control sheet used in the above control test.

Compared to the control sheet, the printing quality of the sheet of the invention is improved and its resistance to the effects of circulation remains unimpaired.

EXAMPLE 2

A sheet is made from the fiber compositions of Example 1 on a papermaking machine. Using a #0.4 Meyer bar, this sheet is coated with an aqueous composition containing, in dry proportion to the total,

| | |
|---|---|
| an elastomeric binder | 5.7 parts |

aqueous dispersion of polyurethane POLYURETHANE V sold by Bayer

| | |
|---|---|
| a mineral filler | 11.5 parts |

Bentonite Copisil D4A10 sold by SOCIETE FRANCAISE DES BENTONITES ET DERIVES
specific surface (BET, nitrogen)=270 $m^2/g$
particle size=2.5 micrometers

| | |
|---|---|
| a plasticizer | 4.5 parts. |

A rheology modifier is added to control the viscosity. The final viscosity is 50 mPa.s at ambient temperature measured with a mobile #1 Brookfield viscosimeter at 100 rpm. The dry weight of the coat is 5 $g/m^2$.

Figure 2:
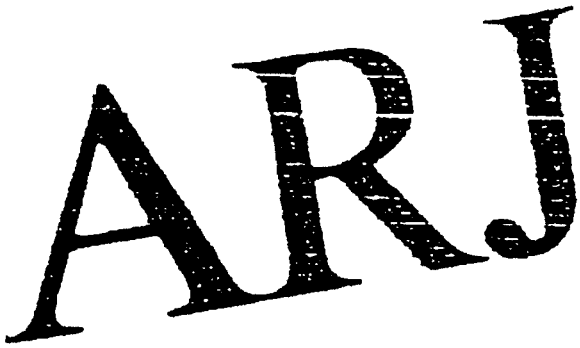
FIG. 2 is a photograph of the printing made on a paper of the invention.
Figure 3:
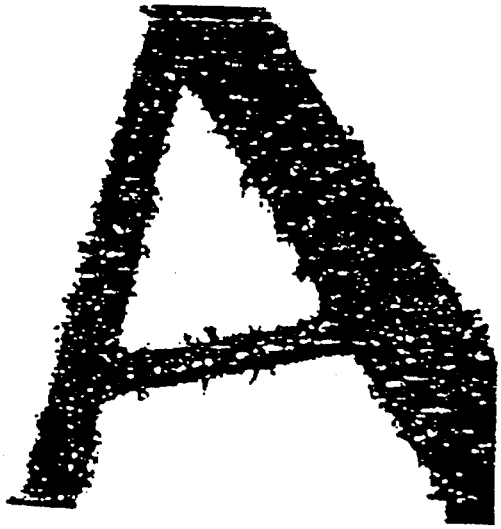
FIG. 3 is a photograph enlarged twenty-fold of the letter A of the printing of FIG. 1.
Figure 4:
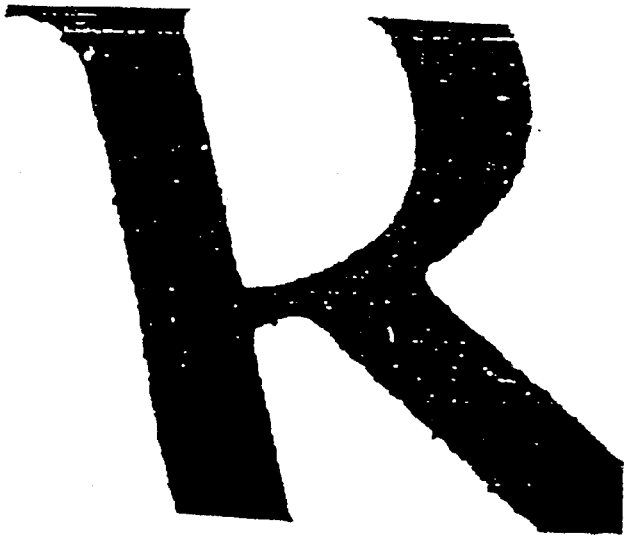
FIG. 4 is a photograph enlarged twenty-fold of the letter R of the printing of FIG. 2.

The sheet is printed and tests are carried out in the manner of Example 1. This sheet (FIGS. 2 and 4) is compared with a control sheet (FIGS. 1 and 3). The printing quality is substantially improved and the resistance to the effects of circulation of the sheet remains unimpaired, and is even improved.

EXAMPLE 3

A sheet is manufactured on a papermaking machine from the fiber composition of Example 1. This sheet is coated using a #0.4 Meyer bar with an aqueous composition comprising, in dry proportion to the total composition:

| | |
|---|---|
| an elastomeric binder | 5.7 parts |

anionic aqueous dispersion of an acrylate copolymer ACRONAL S 360D sold by BASF

| | |
|---|---|
| calcined kaolin ALPHATEX of Example 1 | 6.5 parts |
| Bentonite Copisil D4A10 of Example 2 | 5 parts |

| | |
|---|---|
| a plasticizer | 4.5 parts |

glycerin

To adjust the viscosity, a rheology modifier is added. The final viscosity is 50 mPa.s at ambient temperature as measured with a mobile #1 Brookfield viscosimeter at 100 rpm. The dry weight of the coat is 9 $g/m^2$.

The sheet is printed and the tests of Example 1 are carried out.

Compared with the control, the printing quality was improved and the resistance to the effects of circulation remained unimpaired.

We claim:

1. A printed security document having a substrate which is a paper sheet or plastic sheet, and having intaglio printing directly on a coating on at least one face, of the substrate wherein the coating comprises a composition prepared in an aqueous medium comprising one or more fillers and at least one elastomeric polyurethane binder, the binder being present in more than 25 parts by dry weight per 100 parts by dry weight of the fillers when the coating is substantially dry.

2. The printed security document according to claim 1, wherein the binder is present in about 50 parts by dry weight per 100 parts by dry weight of the fillers.

3. The printed security document according to claim 2, wherein the security document is a bank note.

4. The bank note according to claim 3, wherein the fillers are mineral fillers or plastic pigments.

5. The printed security document according to claim 2, wherein the fillers are mineral fillers or plastic pigments.

6. The printed security document according to claim 5, wherein the mineral fillers are selected from the group consisting of kaolins, silica and bentonite.

7. The printed security document according to claim 6, wherein the mineral filler is bentonite.

8. The printed security document according to claim 1, wherein the fillers have an average particle size in the range of 2–2.5 micrometers.

9. The printed security document according to claim 8, wherein the security document is a bank note.

10. The bank note according to claim 9 wherein the fillers are mineral fillers or plastic pigments.

11. The printed security document according to claim 8, wherein the fillers are mineral fillers or plastic pigments.

12. The printed security document according to claim 11, wherein the mineral fillers are selected from the group consisting of kaolins, silica and bentonite.

13. The printed security document according to claim 12, wherein the mineral filler is bentonite.

14. The printed security document according to claim 13, wherein the coating is on a substrate which is a paper sheet.

15. The printed security document according to claim 1, wherein the security document is a bank note.

16. The bank note according to claim 15, wherein the fillers are mineral fillers or plastic pigments.

17. The printed security document according to claim 1, wherein the fillers are mineral fillers or plastic pigments.

18. The printed security document according to claim 17, wherein the mineral fillers are selected from the group consisting of kaolins, silica and bentonite.

19. The printed security document according to claim 18, wherein the mineral filler is bentonite.

20. The printed security document according to claim 1 wherein the composition prepared in an aqueous medium further comprises a plasticizer.

* * * * *